US008690551B1

(12) United States Patent
Royzen et al.

(10) Patent No.: US 8,690,551 B1
(45) Date of Patent: Apr. 8, 2014

(54) MODULAR SEAL BLADDER FOR HIGH TEMPERATURE APPLICATIONS

(75) Inventors: Arcady Royzen, Norman, OK (US); Alan Howell, Oklahoma City, OK (US); Joseph W. Elder, Oklahoma City, OK (US)

(73) Assignee: GE Oil & Gas ESP, Inc.

( * ) Notice: Subject to any disclaimer, the term of this patent is extended or adjusted under 35 U.S.C. 154(b) by 1512 days.

(21) Appl. No.: 12/151,328

(22) Filed: May 5, 2008

Related U.S. Application Data

(60) Provisional application No. 61/001,866, filed on Nov. 6, 2007.

(51) Int. Cl.
*F04D 29/08* (2006.01)
*E21B 33/00* (2006.01)

(52) U.S. Cl.
USPC ..... 417/414; 277/322

(58) Field of Classification Search
USPC ..... 417/414, 423.3; 166/105.5, 115, 187; 277/322
See application file for complete search history.

(56) References Cited

U.S. PATENT DOCUMENTS

| | | | | |
|---|---|---|---|---|
| 9,466 A | | 12/1852 | Polley | |
| 1,402,504 A | | 1/1922 | Krause | |
| 2,301,340 A | | 11/1942 | Spengler | |
| 2,342,884 A | | 2/1944 | Moore | |
| 2,569,741 A | * | 10/1951 | Arutunoff | 310/87 |
| 3,103,235 A | | 9/1963 | Stringham, III | |
| 3,116,432 A | | 12/1963 | Ekey | |
| 3,167,209 A | | 1/1965 | Jones | |
| 3,173,486 A | | 3/1965 | Smith | |
| 3,209,785 A | | 10/1965 | Mercier | |
| 3,337,222 A | | 8/1967 | Smith et al. | |
| 3,514,113 A | | 5/1970 | Weiswurm | |
| 3,571,636 A | | 3/1971 | Carle et al. | |
| 3,654,964 A | | 4/1972 | Mercier et al. | |
| 3,744,527 A | | 7/1973 | Mercier | |
| 3,945,436 A | | 3/1976 | Nebolsine | |
| 4,940,911 A | * | 7/1990 | Wilson | 310/87 |
| 4,992,689 A | * | 2/1991 | Bookout | 310/87 |
| 5,114,054 A | | 5/1992 | Watson | |
| 5,367,214 A | | 11/1994 | Turner, Jr. | |
| 5,505,327 A | | 4/1996 | Witt | |
| 5,746,112 A | | 5/1998 | Watson | |
| 6,058,532 A | | 5/2000 | Allen | |
| 6,100,616 A | | 8/2000 | Heinig et al. | |
| 6,305,753 B1 | | 10/2001 | Rodrigues | |
| 7,159,508 B1 | | 1/2007 | Birsner | |
| 7,708,534 B2 | * | 5/2010 | Parmeter et al. | 417/423.3 |

* cited by examiner

*Primary Examiner* — Charles Freay
*Assistant Examiner* — Philip Stimpert
(74) *Attorney, Agent, or Firm* — Crowe & Dunlevy

(57) ABSTRACT

A seal section for use in a downhole submersible pumping system includes a modular seal bag assembly having a first end cap, a second end cap and a plurality of seal bags connected between the first and second end caps. Each of the first and second end caps includes a plurality of nozzles and each of the plurality of seal bags is connected to a unique pair of nozzles on the first and second end caps. The modular seal bag assembly further includes a shaft tube connected between the first and second end caps. In a second preferred embodiment, the present invention provides a seal section that includes a single seal bag connected between two opposing end caps. The seal bag is preferably seamless and fabricated from a fluoropolymer, such as perfluoroalkoxy (PFA).

7 Claims, 5 Drawing Sheets

MODULAR SEAL BLADDER FOR HIGH TEMPERATURE APPLICATIONS

RELATED APPLICATIONS

This application claims priority to United. States Provisional Patent Application No. 61/001,866, entitled Modular Seal Bladder for High Temperature Applications, filed Nov. 6, 2007, the disclosure of which is incorporated herein.

FIELD OF THE INVENTION

This invention relates generally to the field of submersible pumping systems, and more particularly, but not by way of limitation, to a seal section bladder system for use with a submersible pumping system.

BACKGROUND

Submersible pumping systems are often deployed into wells to recover petroleum fluids from subterranean reservoirs. Typically, the submersible pumping system includes a number of components, including one or more fluid filled electric motors coupled to one or more high performance pumps. Each of the components and sub-components in a submersible pumping system must be engineered to withstand the inhospitable downhole environment, which includes wide ranges of temperature, pressure and corrosive well fluids.

Components commonly referred to as "seal sections" protect the electric motors and are typically positioned between the motor and the pump. In this position, the seal section provides several functions, including transmitting torque between the motor and pump, restricting the flow of wellbore fluids into the motor, protecting the motor from axial thrust imparted by the pump, and accommodating the expansion and contraction of motor lubricant as the motor moves through thermal cycles during operation. Many seal sections employ seal bags to accommodate the volumetric changes and movement of fluid in the seal section. Seal bags can also be configured to provide a positive barrier between clean lubricant and contaminated wellbore fluid. In the past, seal bags have been constructed by sliding an open-ended bag over cylindrical mounting blocks and fastening the open neck portions to the cylindrical mounting blocks with common hose clamps.

As the use of downhole pumping systems extends to new applications, traditional bladder systems may fail under inhospitable downhole environments. For example, the use of downhole pumping systems in combination with steam assisted gravity drainage (SAGD) technology exposes bladder components to temperatures in excess of 500° F. To increase the resistance of the bladder to degradation under these increasingly hostile environments, manufacturers have employed durable polymers, including various forms of polytetrafluoroethylene (PTFE), as the preferred material of construction. Although PTFE is generally resistant to the harsh downhole environment, the use of PTFE as a material of construction is discouraged by the need to create the bladder with a seam-type design that frustrates efforts to provide an effective seal. There is, therefore, a need for an improved seal bag, seal sections and submersible pumping systems that overcome the deficiencies of the prior art. It is to this and other needs that the present invention is directed.

SUMMARY OF THE INVENTION

In a first preferred embodiment, the present invention provides a seal section for use in a downhole submersible pumping system that includes a modular seal bag assembly having a first end cap, a second end cap and a plurality of seal bags connected between the first and second end caps. Each of the first and second end caps includes a plurality of nozzles and each of the plurality of seal bags is connected to a unique pair of nozzles on the first and second end caps. The modular seal bag assembly further includes a shaft tube connected between the first and second end caps. In a second preferred embodiment, the present invention provides a seal section that includes a single seal bag connected between two opposing end caps. The seal bag in both embodiments is preferably seamless and fabricated from a suitable fluoropolymer, such as perfluoroalkoxy (PFA).

DETAILED DESCRIPTION OF THE PREFERRED EMBODIMENTS

Figure 1:
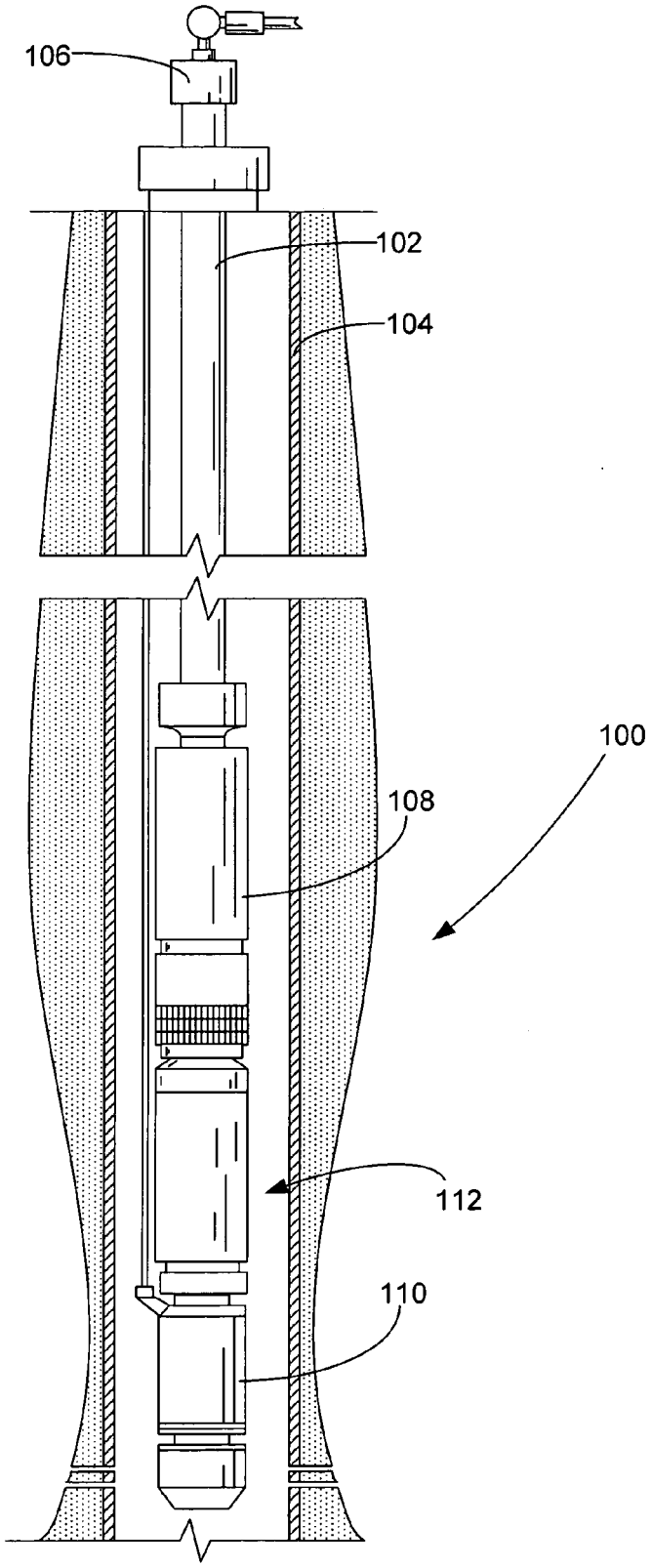
FIG. 1 is an elevational view of a submersible pumping system constructed in accordance with a presently preferred embodiment.

In accordance with a preferred embodiment of the present invention, FIG. 1 shows an elevational view of a pumping system 100 attached to production tubing 102. The pumping system 100 and production tubing 102 are disposed in a wellbore 104, which is drilled for the production of a fluid such as water or petroleum. As used herein, the term "petroleum" refers broadly to all mineral hydrocarbons, such as crude oil, gas and combinations of oil and gas. The production tubing 102 connects the pumping system 100 to a wellhead 106 located on the surface. Although the pumping system 100 is primarily designed to pump petroleum products, it will be understood that the present invention can also be used to move other fluids. It will also be understood that, although each of the components of the pumping system are primarily disclosed in a submersible application, some or all of these components can also be used in surface pumping operations.

The pumping system 100 preferably includes some combination of a pump assembly 108, a motor assembly 110 and a seal section 112. The motor assembly 110 is preferably an electrical motor that receives power from a surface-mounted motor control unit (not shown). When energized, the motor assembly 110 drives a shaft that causes the pump assembly 108 to operate. The seal section 112 shields the motor assembly 110 from mechanical thrust produced by the pump assembly 108 and provides for the expansion of motor lubricants during operation. The seal section 112 also isolates the motor assembly 110 from the wellbore fluids. Although only one of each component is shown, it will be understood that more can be connected when appropriate. The seal section 112 includes a housing (not separately designated) configured to protect the internal components of the seal section 112 from the exterior wellbore environment. It may be desirable to use tandem-motor combinations, multiple seal sections, multiple pump assemblies or other downhole components not shown in FIG. 1.

Figure 2:
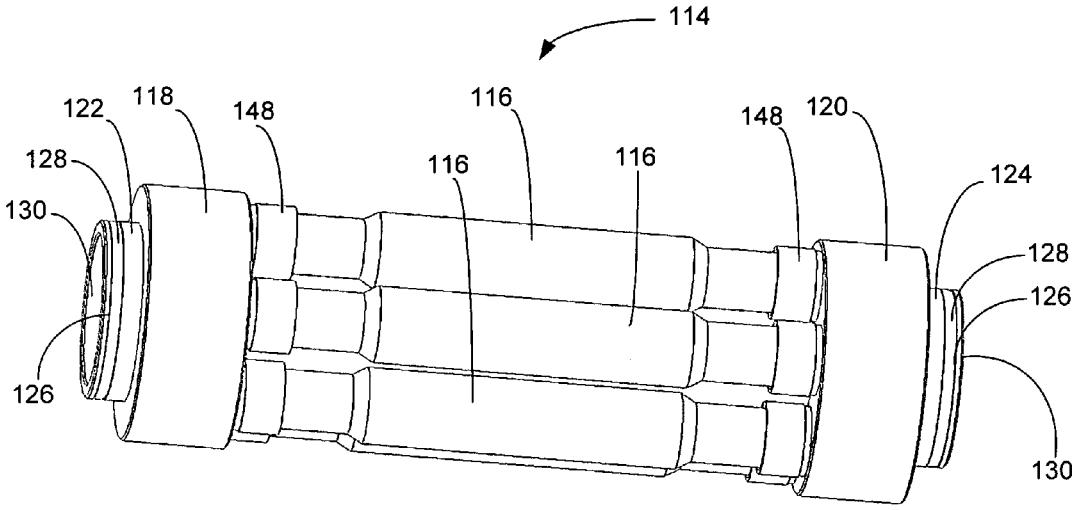
FIG. 2 is a perspective view of the internal components of a seal section from the pumping system in FIG. 1 constructed in accordance with a first preferred embodiment.

Referring now to FIG. 2, shown therein is a perspective view of a modular seal bag assembly 114, which is contained within the seal section 112. According to the first preferred embodiment, the modular seal bag assembly 114 includes a plurality of seal bags 116, a first end cap 118 and a second end cap 120. Each of the first and second end caps 118, 120 includes a cylindrical extension 122, 124, respectively, configured for connection with adjacent components within the seal section 112. Each of the extensions 122, 124 includes a seal groove 126 and seal 128. The extensions 122, 124 each include an exterior opening 130 on the exterior ends of the first and second end caps 118, 120 configured to permit the passage of the shaft (not shown) through the modular seal bag assembly 114. It will be understood that the seal section 112 may include other components in addition to the modular seal bag assembly 114, such as, for example, thrust bearings.

Figure 3:
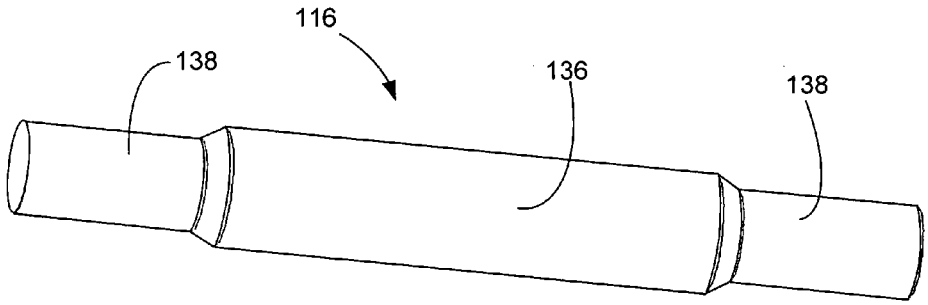
FIG. 3 is a perspective view of the seal bag from the first preferred embodiment of FIG. 2.

Turning to FIG. 3, shown therein is a perspective view of one of the seal bags 116. In the preferred embodiment shown in FIG. 3, the seal bag 116 is configured as a substantially cylindrical tube with a wider central portion 136 and narrower end portions 138 at opposing ends of the seal bag 116. Alternatively, the seal bag 116 is constructed with a constant diameter across the entire length of the seal bag 116. The seal bag 116 is preferably constructed from perfluoroalkoxy polymer (also referred to as PFA), which is commercially available from a number of sources, including E.I. du Pont de Nemours and Company and Daikin Industries. Like PTFE, PFA exhibits favorable resistance to corrosive chemicals and elevated temperatures.

Unlike PTFE, however, PFA is melt-processable using conventional injection molding and screw extrusion mechanisms. The ability to extrude or mold PFA permits the construction of a seamless, unitary seal bag 116. Thus, as an advance over the prior art, the seal bag 116 is a seamless bag that is fabricated using injection molding or extrusion techniques. In the preferred embodiment shown in FIG. 2, the modular seal bag assembly 114 includes six seal bags 116. It will be understood, however, that greater or fewer numbers of seal bags 116 could be used depending on the geometries of the bags and the requirements of the particular application.

Figure 4:
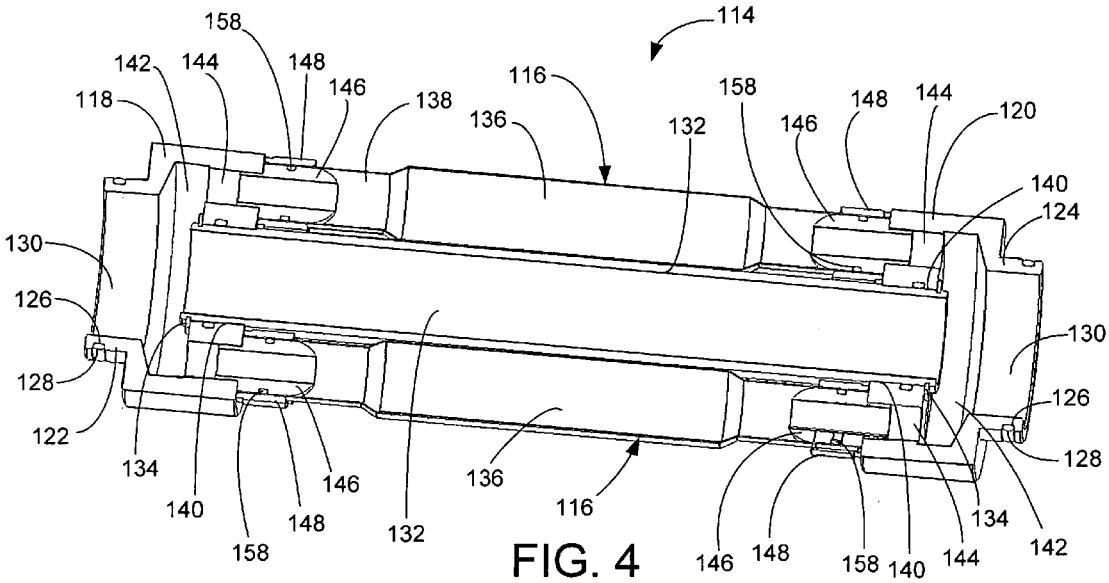
FIG. 4 is a cross-sectional view of the seal section components of FIG. 2.
Figure 5:
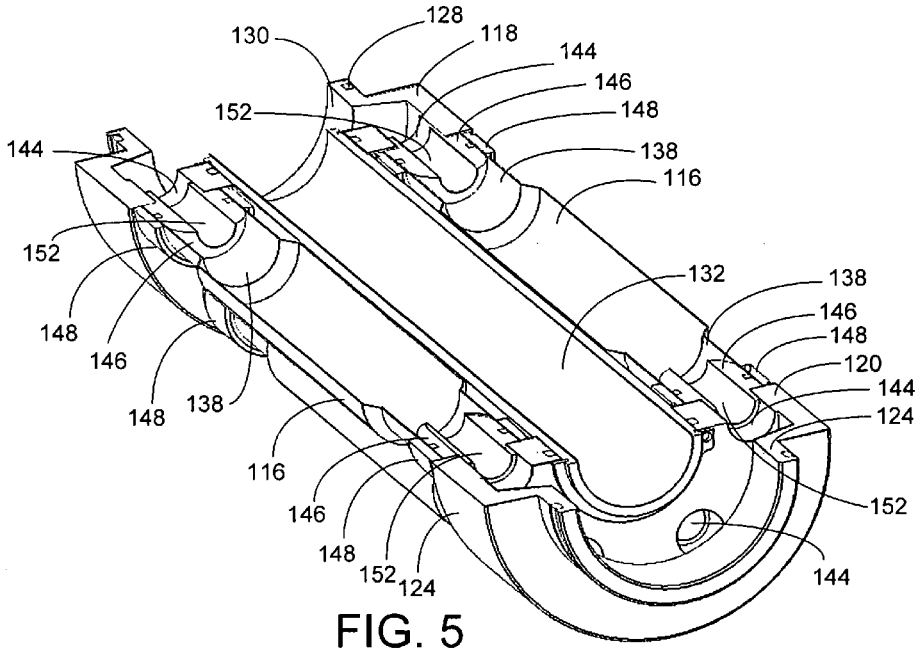
FIG. 5 is a perspective cross-sectional view of the seal section components of FIG. 2.

Turning to FIGS. 4 and 5, shown therein are perspective, cross-sectional views of the modular seal bag assembly 114. As shown in FIGS. 4 and 5, the modular seal bag assembly 114 further includes a shaft tube 132, which isolates the shaft from the surrounding seal bags 116. The shaft tube 132 is secured within shaft tube apertures 140 in the interior ends of the first and second end caps 118, 120 with locking rings 134. To increase the volume in each seal bag 116, the present invention contemplates the configuration of the seal bags 116 in a spiral configuration around the shaft tube 132. The spiral configuration can be achieved by installing seal bags 116 preformed with a spiral configuration or by providing a rotational indexing movement in the end cap 118 relative the end cap 120. Winding the seal bags 116 inside the modular seal bag assembly 114 increases the length and volume of each seal bag 116.

Figure 6:
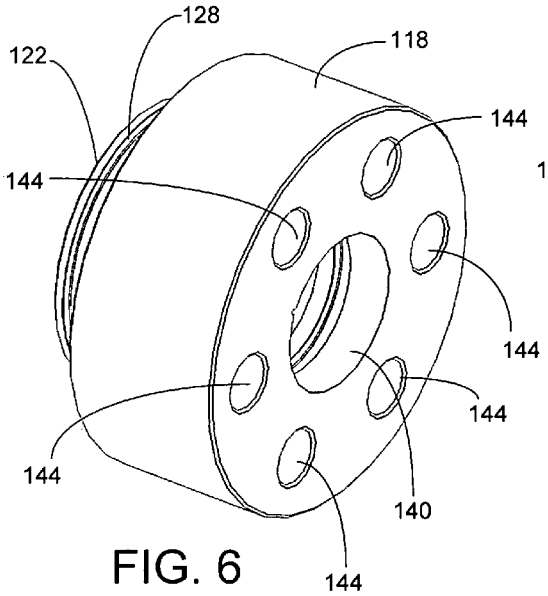
FIG. 6 is a perspective view of one of the end caps from the seal section components of FIG. 2.
Figure 7:
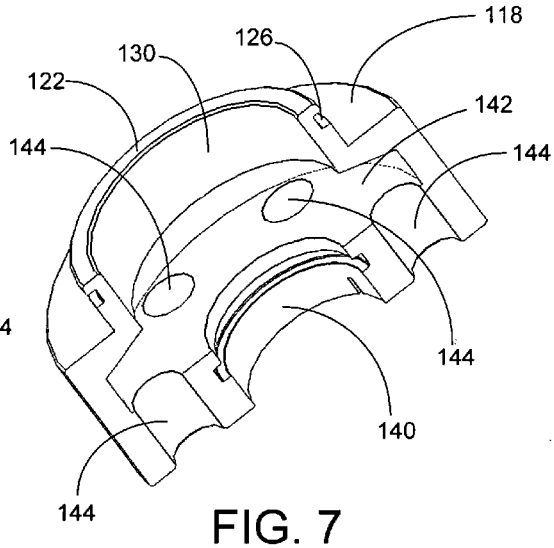
FIG. 7 is a cross-sectional perspective view of the end cap of FIG. 6.

As visible in the cross-sectional views of FIGS. 4 and 5, the end caps 118, 120 each include an interior space 142 and a plurality of holes 144 configured to place the exterior openings in fluid communication with the seal bags 116. FIGS. 6 and 7 provide perspective and cross-sectional views of the end cap 118. It will be understood that end cap 120 is preferably constructed in a similar, if not identical, manner. As shown in FIGS. 6 and 7, the end cap 118 includes six holes 144 equally distributed around the shaft tube aperture 140. The interior space 142 permits the movement of fluid from the exterior opening around the shaft (not shown) through the holes 144 to the seal bags 116.

Figure 8:
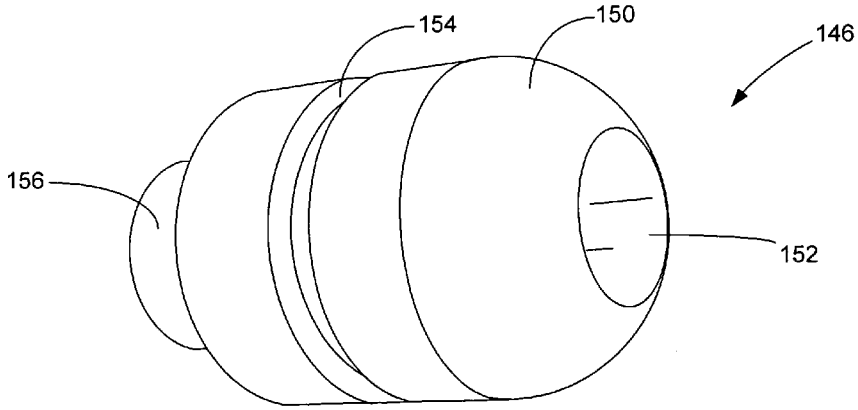
FIG. 8 is a perspective view of a nozzle from the seal section of FIG. 2.

Referring back to FIGS. 4 and 5, the modular seal bag assembly 114 further includes a plurality of nozzles 146 and locking collars 148 configured to secure each of the seal bags 116 within the first and second end caps 118, 120. As shown in FIG. 8, each nozzle 146 includes a head 150, a central passage 152, a seal recess 154 and a stem 156. The seal recess 154 is configured to retain an o-ring seal 158 (not shown in FIG. 8). The stem 156 of each nozzle 146 is configured to be inserted into a hole 144 in the end caps 118, 120. The stems 156 and corresponding holes 144 can be configured for threaded, press-fit or other locking engagement.

The head 150 of the nozzle 146 is configured to fit inside the end portion 138 of the seal bag 116. In a particularly preferred embodiment, the outer diameter of the head 150 is a close fit to the inner diameter of the end portion 138 of the seal bag 116. Manufacturing variations of the seal bag 116 may provide a slip fit, a line-to-line fit, or an interference fit of the nozzle 146 and the end portion 138. The elasticity of the PFA permits the end portion 138 to expand to form a tight seal around the nozzle 146. The o-ring seal 158 further improves the sealed engagement between the end portion 138 of the seal bag 116 and the nozzle 146. When the o-ring seal 158 is placed in the seal recess 156, the exterior diameter of the o-ring seal 158 is always larger than the inner diameter of the end portion 138 of the seal bag 116. The seal bag 116 is held in place over the nozzle 146 by the locking collar 148, which applies a compressive force on the end portion 138 of the seal bag 116. The compressive force of the locking collar 148 further improves the sealed engagement between the end portion 138 of the seal bag 116 and the o-ring seal 158. The central passage 152 permits the transfer of fluid from the seal bag 116 through the nozzle 146 and corresponding hole 144 to the end caps 118, 120.

Figure 9:
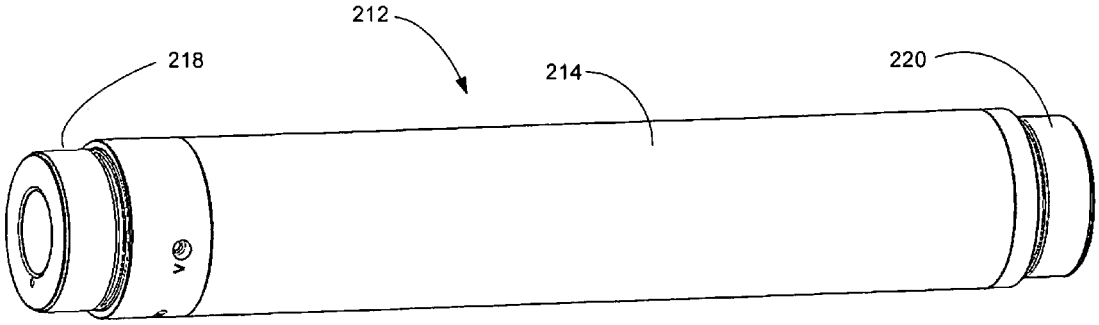
FIG. 9 is a is a perspective view of the components of a seal section from the pumping system of FIG. 1 constructed in accordance with a second preferred embodiment.
Figure 10:
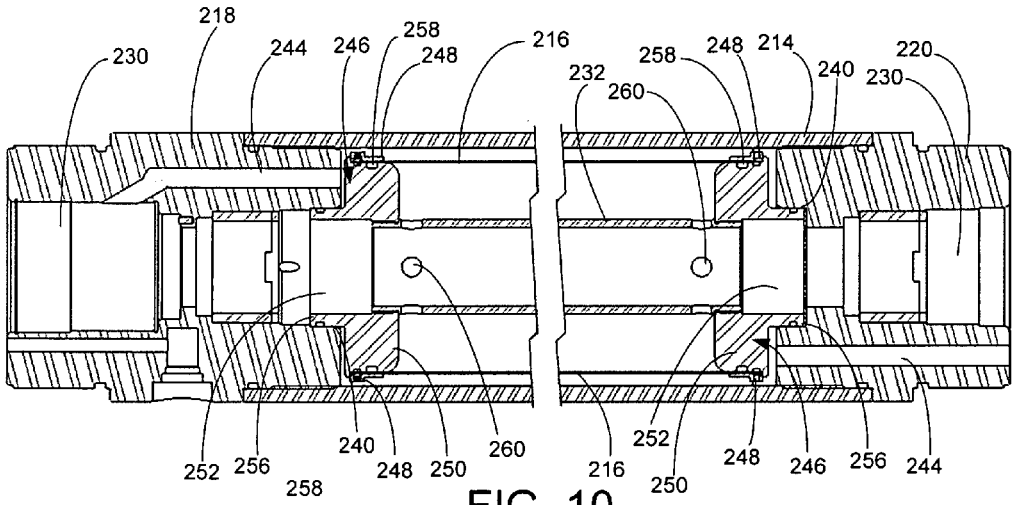
FIG. 10 is a cross-sectional view of the second preferred embodiment of the seal section of FIG. 9.
Figure 11:
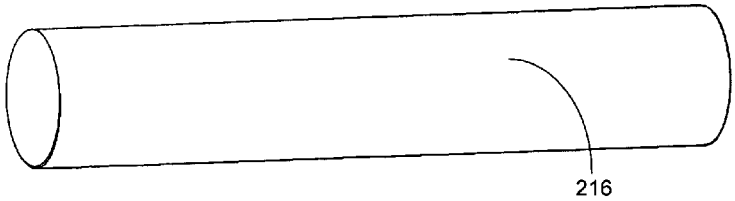
FIG. 11 is a perspective view of the seal bag from the second preferred embodiment shown in FIG. 9.

Turning to FIGS. 9-10, shown therein is a seal section 212 constructed in accordance with an alternate preferred embodiment of the present invention. The seal section 212 includes a housing 214, a seal bag 216 and end caps 218; 220. The end caps 218, 220 each include an exterior opening 230 and an interior opening 240. The first and second end caps 218, 220 further include fluid passages 244 that permit the exchange of fluid through the seal section 212.

Unlike the modular seal bag assembly 114, which includes more than one seal bag 116, the seal section 212 includes a single, larger seal bag 216. In a particularly preferred embodiment, the seal bag 216 is constructed from PFA or similar fluoropolymer through an extruded or injection-molded manufacturing process that produces a seamless, unitary construction.

The seal section 212 further includes a shaft tube 232, two tube holders 246 and two locking collars 248. The shaft tube 232 is configured to be partially inserted into the central passages 252 of each of the tube holders 246. The shaft tube 232 preferably includes ports 260 configured to permit the movement of fluid from around the shaft (not shown) to the interior of the seal bag 216.

Each of the tube holders 246 includes a head 250, a central passage 252, a stem 256 and an o-ring 258. The stems 256 are each configured for insertion into the interior openings 240 of the end caps 218, 220. In a particularly preferred embodiment, the outer diameter of the head 250 is a close fit to the inner diameter of the seal bag 216. Manufacturing variations of the seal bag 216 may provide a slip fit, a line-to-line fit, or an interference fit of the head 250 and the seal bag 216. The elasticity of the PFA permits the seal bag 216 to expand to form a tight seal around the head 250 of the tube holder 246.

The o-ring 258 further improves the sealed engagement between the seal bag 216 and the tube holder 246. When the o-ring seal 258 is placed in the head 250, the exterior diameter of the o-ring seal 258 is larger than the inner diameter of the seal bag 216. The seal bag 216 is held in place over the head 250 by the locking collar 248, which applies a compressive force on the seal bag 216. The compressive force of the locking collar 248 further improves the sealed engagement between the seal bag 216 and the o-ring seal 258. The seal bag 216 is held in place over the tube holder 246 by the locking collar 248, which applies a compressive force on the seal bag 216 that is opposed by the exterior of the tube holder 246. The central passage 252 permits the passage of the shaft (not shown) through the interior of the seal bag 216.

For purposes of illustration, these assemblies have been disclosed as contained within the seal section 112. It will be understood, however, that the modular bag seal assembly and single bag seal assembly could be installed elsewhere in the pumping system 100. For example, it may be desirable to integrate the bag seal assembly within the motor assembly 110 or pump assembly 108.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A modular seal bag assembly for use within a seal section of a downhole submersible pumping system, the modular seal bag assembly comprising:

a first end cap, wherein the first end cap further comprises:

an exterior opening on an exterior end of the first end cap;

a shaft tube aperture on an interior end of the first end cap;

an interior space inside the first end cap; and a plurality of holes extending from the interior end of the first end cap to the interior space;

a second end cap, wherein the second end cap further comprises:

an exterior opening on an exterior end of the second end cap;

a shaft tube aperture on an interior end of the second end cap;

an interior space inside the second end cap; and a plurality of holes extending from the interior end of the second end cap to the interior space;

a shaft tube connected between the first and second end caps;

a plurality of seal bags connected to the first and second end caps; and a plurality of nozzles connected to the first end cap and a plurality of nozzles connected to the second end cap, wherein each one of the plurality of nozzles connected to the first end cap is connected to a separate one of the plurality of holes on the interior end of the first end cap and each one of the plurality of nozzles connected to the second end cap is connected to a separate one of the plurality of holes on the interior end of the second end cap.

2. The modular seal bag assembly of claim 1, wherein each of the plurality of nozzles includes a stem, a head and a central passage.

3. The modular seal bag assembly of claim 1, wherein each of the plurality of seal bags includes first and second opposing end portions, wherein the first opposing end portion is secured on a separate one of the plurality of nozzles on the first end cap and the second opposing end is secured on a separate one of the plurality of nozzles on the second end cap.

4. The modular seal bag assembly of claim 3, further comprising a plurality of locking collars placed over the end portions of each of the plurality of seal bags, wherein each of the plurality of locking collars is configured to exert a compressive force against the end portion of the seal bag.

5. The modular seal bag assembly of claim 3, wherein each of the plurality of nozzles includes a central passage configured to permit the transfer of fluid from a corresponding seal bag to the interior space of the first or second end cap.

6. The modular seal bag assembly of claim 3, wherein the shaft tube is connected to the shaft tube apertures in the first and second end caps.

7. A modular seal assembly comprising:

a first end cap;

a plurality of nozzles attached to the first end cap;

a second end cap;

a plurality of nozzles attached to the second end cap;

a plurality of seal bags, wherein each of the plurality of seal bags is connected to a unique pair of nozzles on the first and second end caps; and a shaft tube connected between the first and second end caps.

* * * * *